US012146698B1

(12) United States Patent
Zhang et al.

(10) Patent No.: US 12,146,698 B1
(45) Date of Patent: Nov. 19, 2024

(54) ICE MACHINE

(71) Applicant: NINGBO AQUART ELECTRICAL APPLIANCE CO., LTD, Zhejiang (CN)

(72) Inventors: Chunyun Zhang, Zhejiang (CN); Meige Lyu, Zhejiang (CN); Qiang Zhang, Zhejiang (CN); Zhengbo Ding, Zhejiang (CN)

(73) Assignee: NINGBO AQUART ELECTRICAL APPLIANCE CO., LTD, Zhejiang (CN)

( * ) Notice: Subject to any disclaimer, the term of this patent is extended or adjusted under 35 U.S.C. 154(b) by 0 days.

(21) Appl. No.: 18/600,858

(22) Filed: Mar. 11, 2024

(30) Foreign Application Priority Data

Nov. 30, 2023 (CN) ..... 202311629434.3

(51) Int. Cl.
*F25C 1/147* (2018.01)
*F25C 5/182* (2018.01)

(52) U.S. Cl.
CPC ..... *F25C 1/147* (2013.01); *F25C 5/182* (2013.01); *F25C 2400/04* (2013.01); *F25C 2400/14* (2013.01)

(58) Field of Classification Search
CPC ..... F25C 1/147; F25C 1/182; F25C 2400/04; F25C 2400/14
See application file for complete search history.

(56) References Cited

FOREIGN PATENT DOCUMENTS

| | | | | |
|---|---|---|---|---|
| CN | 105758104 | A | | 7/2016 |
| CN | 111879047 | A | | 11/2020 |
| CN | 217504063 | U | * | 9/2022 |
| CN | 115388581 | A | | 11/2022 |
| JP | 2000081261 | A | | 3/2000 |
| JP | 2017161095 | A | | 9/2017 |

OTHER PUBLICATIONS

CN 21704063 Translation.*
Office Action received in corresponding Chinese patent application No. 202311629434.3, dated Jul. 17, 2024, 22 pages.

* cited by examiner

*Primary Examiner* — Elizabeth J Martin
(74) *Attorney, Agent, or Firm* — Cooper Legal Group, LLC

(57) ABSTRACT

An ice machine includes a casing, a refrigeration assembly, an ice conveying assembly, an ice storage bin and an ice guide channel are provided in the casing, the ice conveying assembly includes an ice-making drum in connection with the refrigeration assembly, an ice conveying screw rotatably provided in the ice-making drum, a motor configured to drive the ice conveying screw to rotate, and an extruder on the ice-making drum, the ice guide channel is configured with an output compartment configured for outputting ice cubes, the output compartment is arranged corresponding to the extruder, the output compartment is configured with a gap on a side of the extruder away from the ice storage bin, and the gap is configured for the ice cubes to climb over a top of the extruder.

13 Claims, 11 Drawing Sheets

A

ICE MACHINE

CROSS-REFERENCE TO RELATED APPLICATION

This application claims the priority and benefit of Chinese patent application serial no. 202311629434.3, filed on Nov. 30, 2023. The entirety of Chinese patent application serial no. 202311629434.3 is hereby incorporated by reference herein and made a part of this specification.

TECHNICAL FIELD

The disclosure relates to the field of ice-making technology, and in particular, to an ice machine.

BACKGROUND ART

An ice machine is a refrigeration machine that does work by compressing or expanding liquid refrigerant to produce high-temperature and high-pressure gas (steam), such that the liquid can quickly evaporate and be vaporized.

By existing domestic or commercial ice machines, the compression refrigerators are usually used. In existing technology, an ice machine mainly includes a casing, a refrigeration assembly, an ice conveying assembly and an ice storage bin. After the water condenses into ice through the refrigeration assembly, it is transported to the ice storage bin for storage through the ice conveying assembly. The ice conveying assembly includes a drive motor, an ice-making drum and an extruder. The extruder is a screw that is rotatably disposed in the ice-making drum and is coaxially connected to the drive motor. The water condenses into cylindrical ice cubes in the ice-making drum and are transported upward with the rotation of the screw. The top of the extruder is circumferentially configured with output through holes in communication with the ice-making drum, the ice cubes is output through the output through holes. The ice cubes are automatically broken when they come out of the output through holes and abut against the extruder, and then are transported to the ice storage bin along an ice guide channel.

When the ice cubes in the above-mentioned ice machine are output from the output through holes, they spread outward along the axis of the ice-making drum. However, only the side of the extruder facing the ice storage bin is directly connected to the ice storage bin, so that the ice cubes which are output from the side of the extruder far away from the ice storage bin are prone to blockage, which affects the transfer efficiency of the ice cubes.

SUMMARY

In order to reduce the probability of block of ice cubes on the side of the output compartment away from the guide compartment, the disclosure provides an ice machine including a casing, a refrigeration assembly, an ice conveying assembly, an ice storage bin, and an ice guide channel are provided in the casing, the ice conveying assembly includes an ice-making drum in connection with the refrigeration assembly, an ice conveying screw rotatably provided in the ice-making drum, a motor configured to drive the ice conveying screw to rotate, and an extruder on the ice-making drum, the ice guide channel is configured with an output compartment configured for outputting ice cubes, the output compartment is arranged corresponding to the extruder, the output compartment is configured with a gap on a side of the extruder away from the ice storage bin, and the gap is configured for the ice cubes to climb over to a top of the extruder.

Optionally, the ice guide channel further includes a guide compartment configured for transporting the ice cubes, the guide compartment is in communication with the ice storage bin and the output compartment, a top wall of the output compartment is provided with a guide cambered surface configured to guide the ice cubes to the gap, and the gap extends toward the guide compartment to a position above the ice storage bin.

Optionally, the ice guide channel further includes a delivery plate fixedly mounted on the extruder and a cover plate configured for covering the delivery plate, the delivery plate is provided with a first positioning assembly configured for fixation, and the cover plate is provided with a second positioning assembly configured for fixation.

Optionally, the first positioning assembly includes a first positioning lug on an outer wall of the delivery plate, a positioning column configured to abut against the extruder and a positioning sleeve configured to be sleeved on the extruder, the casing is provided with a positioning plate configured to abut against the first positioning lug for positioning, and the positioning plate is configured with a positioning socket into which one end of the delivery plate is inserted.

Optionally, the second positioning assembly includes a plurality of second positioning lugs on an outer wall of the cover plate, a first part of the plurality of second positioning lugs are fixedly connected to the positioning plate, a second part of the plurality of second positioning lugs are fixedly connected to the delivery plate, and the delivery plate is provided with a positioning flange configured to abut against the second part of the plurality of second positioning lugs.

Optionally, a seal assembly configured for hermetic connecting with the motor is provided in the ice-making drum, the seal assembly includes a static ring fixed on a bottom of the ice-making drum, a dynamic ring sleeved on the ice conveying screw, and an elastic member configured for connecting the dynamic ring and the static ring.

Optionally, a water supply assembly configured to provide a water source for the refrigeration assembly is provided in the casing, the water supply assembly includes a water supply liner at a bottom of the ice storage bin, a water storage tank connected to the water supply liner and a water pump, and the water storage tank is in communication with the ice-making drum.

Optionally, a plurality of backflow holes in communication with the water supply liner are provided spaced apart at the bottom of the ice storage bin, and an overflow hole in communication with a top of the water storage tank is defined on a side wall of the ice guide channel.

Optionally, an external water tank assembly is provided outside the casing, the external water tank assembly includes an external connected seat configured to be connected to the casing, an external water tank plugged in the external connected seat and a communication valve configured to control a water discharge of the external water tank, and the external water tank assembly is in communication with the water supply liner.

Optionally, the casing is configured with an opening, through which the ice storage bin is slidably mounted, a limiter is provided on a side wall of the ice storage bin in a sliding direction, a limit column corresponding to the limiter is provided on a side wall of the casing, and the limiter is provided with an anti-dropping part configured to be matched with the limit column for limiting position.

Optionally, a guide bevel is provided on a side of the ice storage bin facing the water supply liner, the guide bevel includes an upper guide surface and a lower guide surface, the upper guide surface is inclined downward in a direction away from the abutment plate, and the lower guide surface is inclined upward in the direction away from the abutment plate.

Optionally, a first end of the limiter is configured with an arc-shaped groove configured for accommodating the limit column, a second end of the limiter away from the arc-shaped groove is provided with an abutment surface slidably abutting against the limit column, and when the limit column is located in the arc-shaped groove, the ice storage bin is inclined downward in a direction away from the casing.

Optionally, an abutment plate configured for abutting against an outer wall of the casing is provided on a side of the ice storage bin away from the guide bevel, and a groove configured to be pulled by users is defined at a bottom of the abutment plate.

Optionally, a push mechanism configured for pushing crushed ice is further provided on the ice guide channel, and the push mechanism includes a guide plate assembly rotatably arranged on the cover plate and a push assembly arranged on the guide plate assembly in a lifting manner.

Optionally, the guide plate assembly includes a first side plate located in the guide compartment, a second side plate connected to the first side plate and a rotatable plate, the cover plate is provided with a driver configured for rotating the rotatable plate, the push assembly includes a push arm disposed on a side of the output compartment close to the guide compartment, a shifter configured to rotate the push arm, and a lifter configured to lift the push arm.

To sum up, at least the following beneficial technical effects are realized:

1. The ice cubes in the output compartment on the side away from the ice storage bin can climb up to the top of the extrusion body by climbing across the gap and guide cambered surface in the output compartment, and then directly slide down to the ice storage bin, so as to reduce the probability that the ice cubes in the output compartment on the side away from the ice storage bin block.
2. Due to the external water tank assembly, when the water supply liner needs to be replenished, it is only necessary to replenish water to the external water tank, so that the movement of the ice machine is more convenient.
3. Due to the push mechanism, when the ice making is stopped or the ice cubes in the output compartment on the side away from the ice storage bin block, the guide plate assembly is rotated and the push assembly is pushed back and forth, which further improves the output efficiency of the ice cubes.

DETAILED DESCRIPTION

The disclosure will be further described in detail below in combination with FIGS. 1-11.

Embodiment 1

Figure 1:
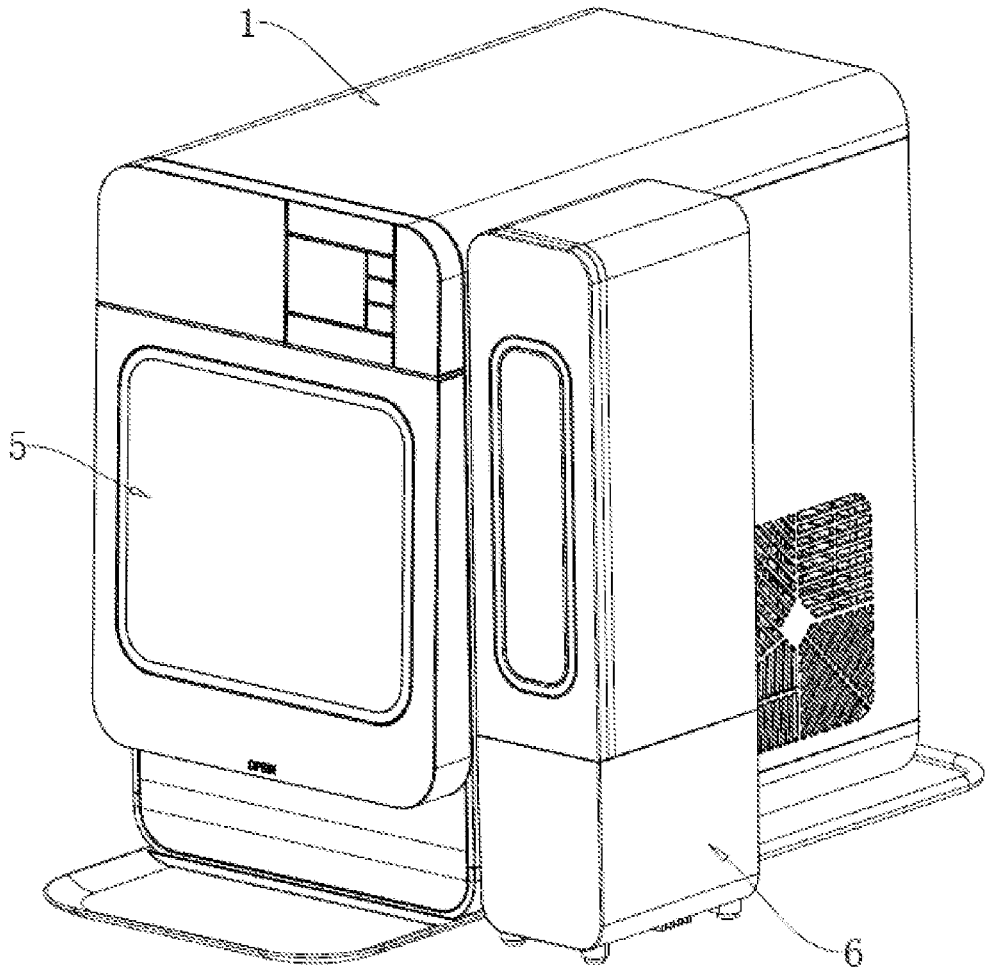
FIG. 1 is a schematic diagram of an overall structure of Embodiment 1.
Figure 2:
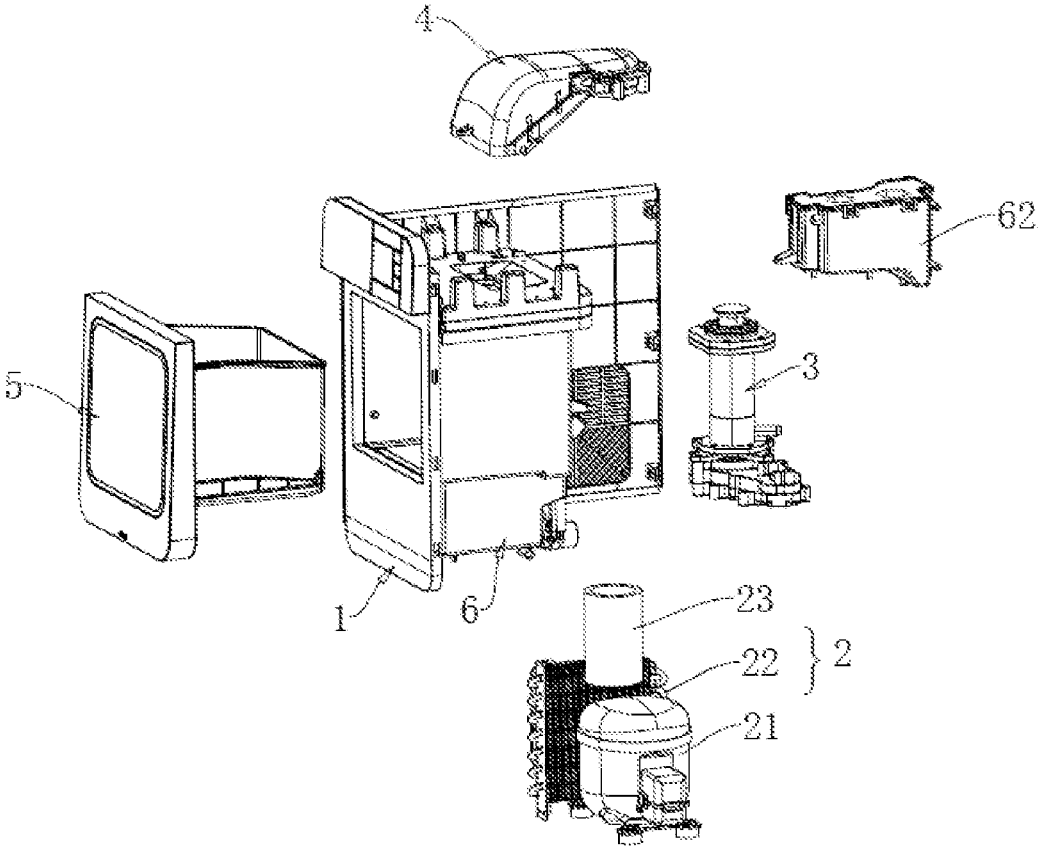
FIG. 2 is an exploded schematic diagram of the Embodiment 1.

Referring to FIG. 1 and FIG. 2, an ice machine includes a casing 1. A refrigeration assembly 2, an ice conveying assembly 3, an ice guide channel 4, an ice storage bin 5 and a water supply assembly 6 are provided in the casing 1.

Figure 3:
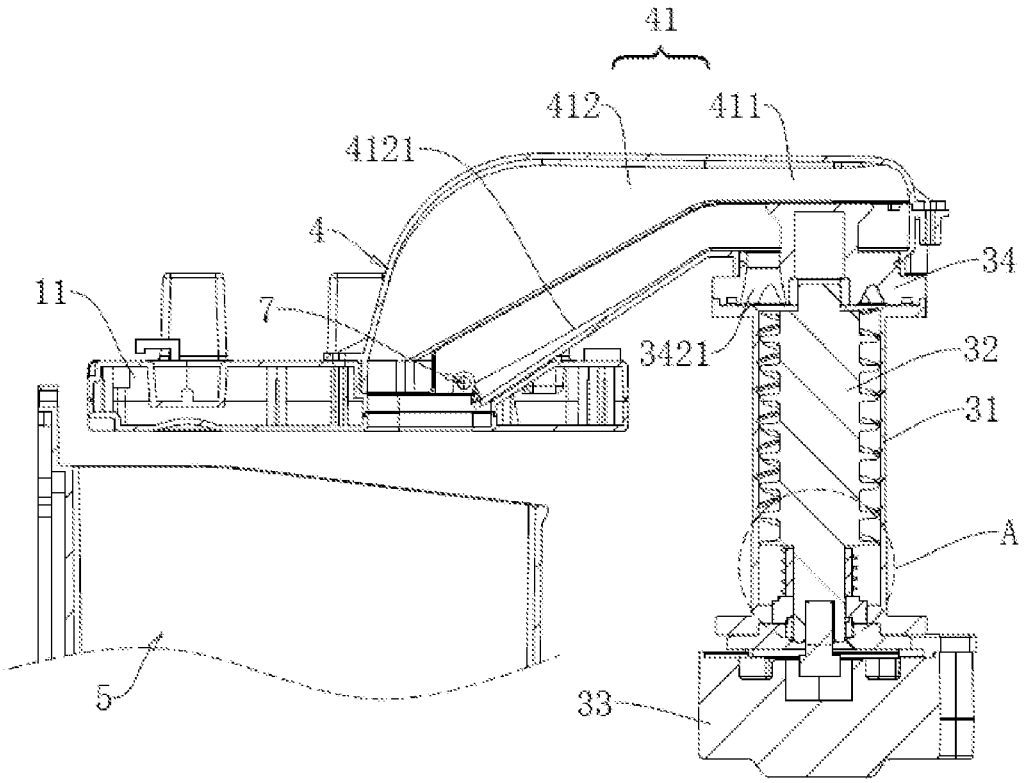
FIG. 3 is a schematic cross-sectional view of the ice guide channel and ice conveying assembly of the Embodiment 1.

Referring to FIG. 2 and FIG. 3, the refrigeration assembly 2 is an existing technology and includes a compressor 21, a condenser 22, an evaporator 23 and an expansion valve. In particular, the compressor 21 and the condenser 22 are both fixedly installed at the bottom of the ice conveying assembly 3. The evaporator 23 is sleeved on the ice conveying assembly. The ice conveying assembly 3 includes an ice-making drum 31 installed vertically in the casing 1, an ice conveying screw 32 rotationally provided in the ice-making drum 31, a motor 33 for rotating the ice conveying screw 32, and an extruder 34 on the ice-making drum 31.

Figure 4:
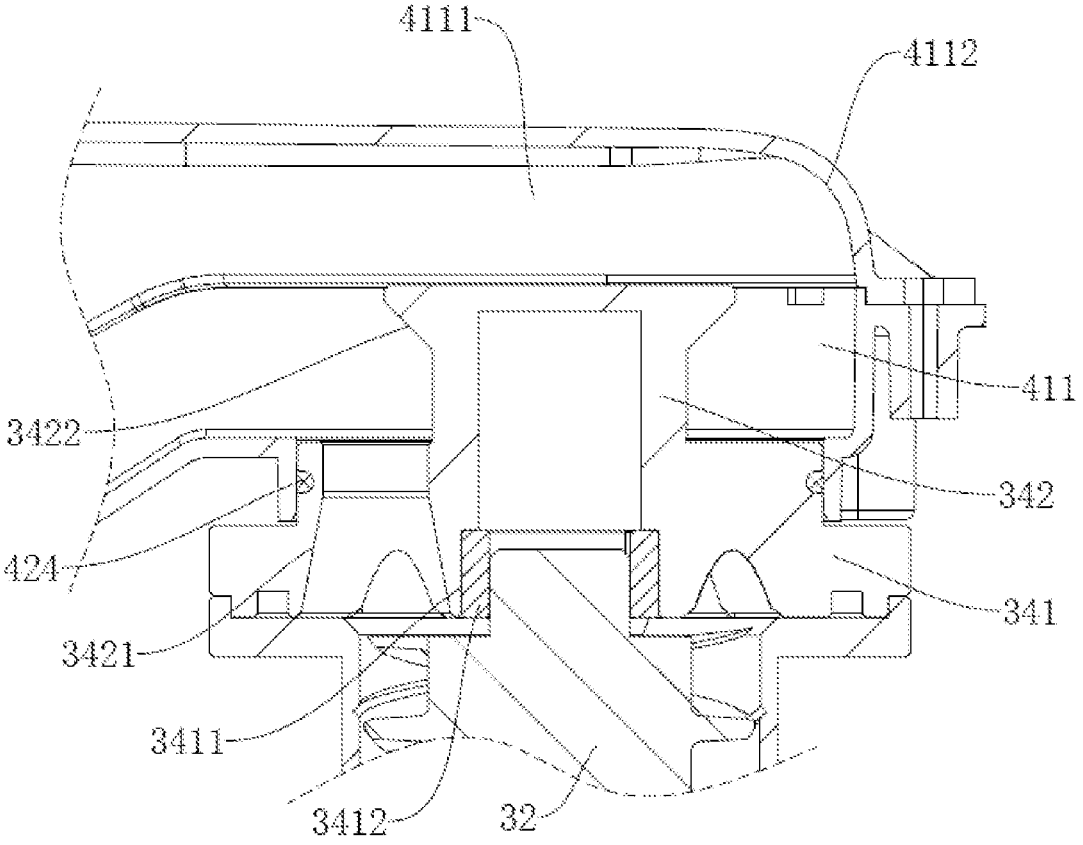
FIG. 4 is a partial schematic cross-sectional view of the output compartment of the Embodiment 1.

Referring to FIG. 3 and FIG. 4, the motor 33 is fixedly installed at the bottom of the ice-making drum 31 and is fixedly screwed to the ice-making drum 31. The output shaft of the motor 33 is coaxially connected with the ice conveying screw 32. The extruder 34 includes a connection plate 341 fixedly screwed to the ice-making drum 31 and an extrusion body 342 for outputting ice cubes. The extrusion body 342 is configured with output through holes 3421 in communication with the ice-making drum 31, which are configured to output ice cubes. The output through holes 3421 are evenly spaced in the circumferential direction. The inner diameter of the output through hole 3421 is gradually increased from the bottom upward to facilitate the output of ice cubes. The top of the extrusion body 342 is provided with a conical abutment surface 3422 for outputting and abutting the ice cubes. The ice cubes are bent and broken when they contact the conical abutment surface 3422.

The bottom of the connection plate 341 is configured with a mounting hole 3411 configured for rotationally mounting the end of the ice conveying screw 32. The connection plate 341 is mounted with an isolation ring 3412 on the inner wall of the mounting hole 3411. The isolation ring 3412 in this embodiment is made of POM material and is configured to separate the ice conveying screw 32 from the extruder 34, so as to reduce the noise caused by the rotation of the ice conveying screw 32.

With reference to FIG. 2, water is transported into the ice-making drum 31 by means of the water supply assembly 6. The water in the ice-making drum 31 is cooled by the refrigeration assembly 2. The ice cubes in the ice-making drum 31 are transported upward to the top of the ice-making drum 31 by means of the ice conveying screw 32. After the ice cubes pass through the output through holes 3421, they are transported to the ice storage bin 5 for storing ice cubes under the guidance of the ice guide channel 4.

A delivery chamber 41 configured for connecting the extruder 34 and the ice storage bin 5 is defined in the ice guide channel 4. The delivery chamber 41 includes an output compartment 411 corresponding to the extruder 34 and a guide compartment 412 for guiding the ice cubes. After the ice cubes are output from the output through holes 3421 and abut against the conical abutment surface 3422, the ice cubes are broken and fall into the output compartment 411 due to the continuous output of the ice cubes, and the newly produced ice cubes can push the forgoing broken ice cubes toward the guide compartment 412. The guide compartment 412 is provided with a delivery slope 4121, which is inclined toward the ice storage bin 5.

The output compartment 411 is configured with a gap 4111 on the side of the extruder 34 away from the guide compartment 412 for the ice cubes to climb over the top of the extruder 34. The height of the gap 4111 in the height direction is greater than the inner diameter of the delivery through hole. The gap 4111 extends in the horizontal direction to an end of the guide compartment 412 away from the output compartment 411, that is, corresponds to the ice storage bin 5.

The inner top wall of the guide compartment 412 is provided with a guide cambered surface 4112 for ice cubes to climb over. The ice cubes is guided to the top of the extruder 34 through the guide cambered surface 4112. The ice cubes located on the top of the extruder 34 are directly pushed to the delivery slope 4121 by subsequent ice cubes.

The guide compartment 412 is mounted with an infrared sensor 7 on the side away from the extruder 34 for monitoring the falling of the ice cubes. When the ice cubes are transported from the guide compartment 412 to the ice storage bin 5, the ice cubes block the light emitted by the infrared sensor 7, such that the infrared sensor 7 detects the falling ice cubes. The sensor is used to monitor whether the ice making function is normal.

Figure 5:
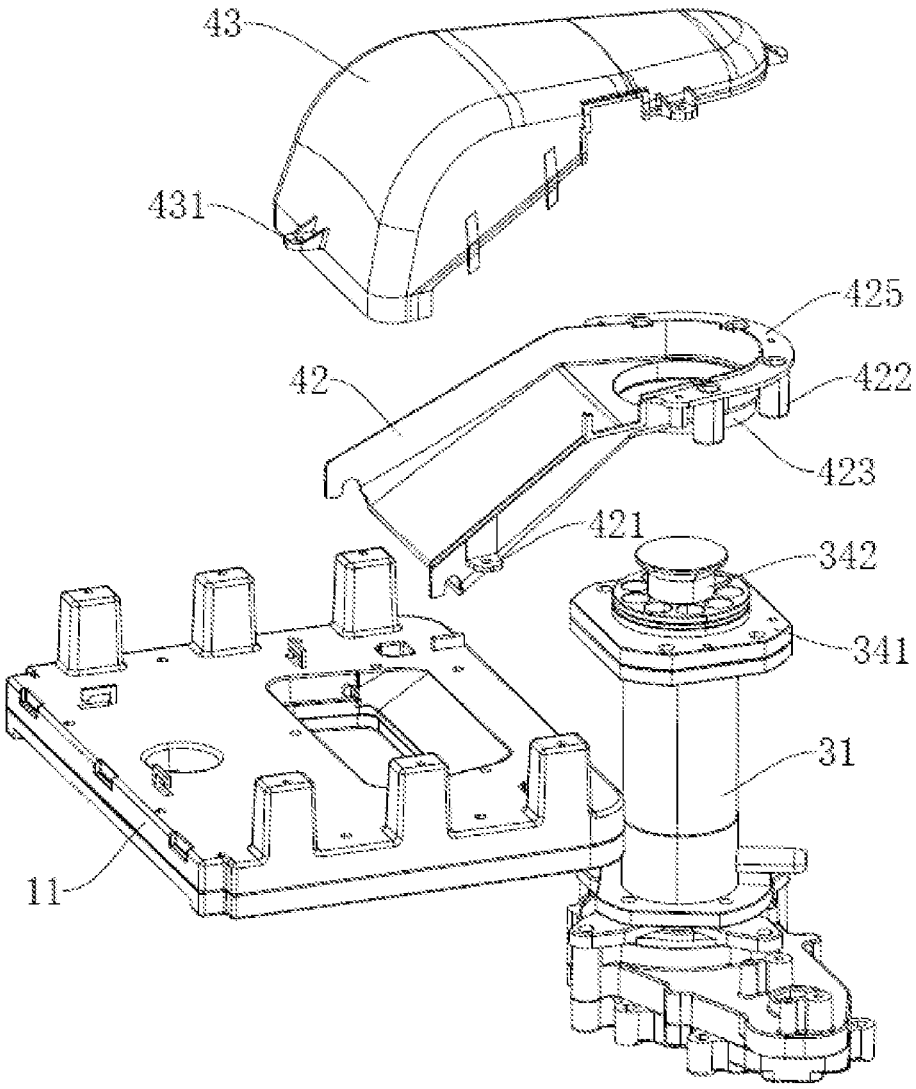
FIG. 5 is an exploded schematic diagram of the ice guide channel of the Embodiment 1.

Referring to FIG. 3 and FIG. 5, the ice guide channel 4 includes a delivery plate 42 and a cover plate 43. The delivery plate 42 together with the cover plate 43 form a delivery chamber 41 connecting the extruder 34 with the ice storage bin 5. The delivery plate 42 is provided with a first positioning assembly for fixation. The first positioning assembly includes first positioning lugs 421 respectively formed on both side walls of the delivery plate 42 integrally, positioning columns 422 and a positioning sleeve 423. The casing 1 is provided with a positioning plate 11 configured to abut against the first positioning lugs 421. The first positioning lugs 421 are fixedly screwed to the positioning plate 11. The positioning column 422 is integrally formed on the outer side wall of the output compartment 411 for positioning and abutting against the connection plate 341 of the extruder 34. The positioning sleeve 423 penetrates the upper and lower end surfaces of the delivery plate 42 for positioning and being sleeved on the extrusion body 342 of the extruder 34. In particular, a sealing ring 424 abutting against the extruder 34 is hermetically installed on the inner wall of the positioning sleeve 423, to achieve a sealed assembly of the delivery plate 42 and the extruder 34.

The cover plate 43 is provided with a second positioning assembly for fixing. The second positioning assembly includes a plurality of second positioning lugs 431 integrally formed on the outer side wall of the cover plate 43. In this embodiment, the cover plate 43 is provided with four second positioning lugs 431. One of the second positioning lugs 431 is located on the side of the cover plate 43 away from the extruder 34. This second positioning lug 431 is fixed with the positioning plate 11 in the same manner as the first positioning lug 421. The other three of the second positioning lugs 431 are circumferentially arranged at one end of the cover plate 43 close to the extruder 34. The delivery plate 42 is provided with positioning flanges 425 for positioning and abutting against the above mentioned three second positioning lugs 431. The positioning column 422 is integrally formed at the bottom of the positioning flange 425.

Figure 6:
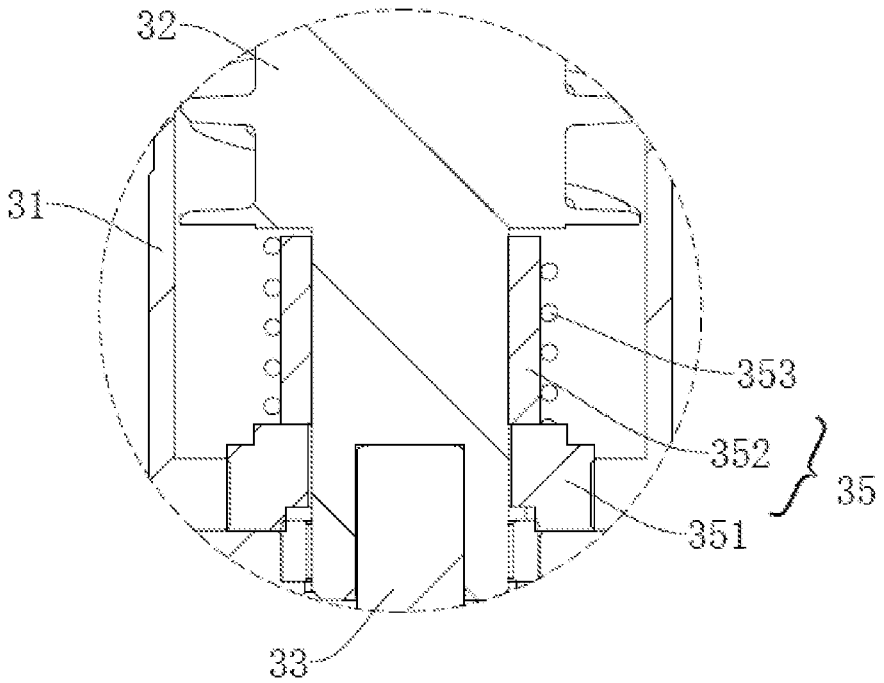
FIG. 6 is a partial enlarged schematic diagram of portion A in FIG. 3.

Referring to FIG. 6, a seal assembly 35 is also installed at the bottom of the inner cavity of the ice-making drum 31. The seal assembly 35 is configured to achieve a hermetic connection between the ice-making drum 31 and the output motor. The seal assembly 35 includes a static ring 351 fixed at the bottom of the ice-making drum 31, a dynamic ring 352 at the top of the static ring 351, and an elastic member 353 configured for connecting the dynamic ring 352 and the static ring 351. The dynamic ring 352 is located in the bottom through hole of the ice-making drum 31. The dynamic ring 352 and the static ring 351 are both hermetically sleeved on the ice conveying screw 32. The elastic member 353 is a spring. When the ice conveying screw 32 rotates, the static ring 351 is in a stationary state, while the dynamic ring 352 and the ice conveying screw 32 rotate synchronously. The elastic member 353 can buffer the axial movement of the ice conveying screw 32 during its rotation.

Figure 7:
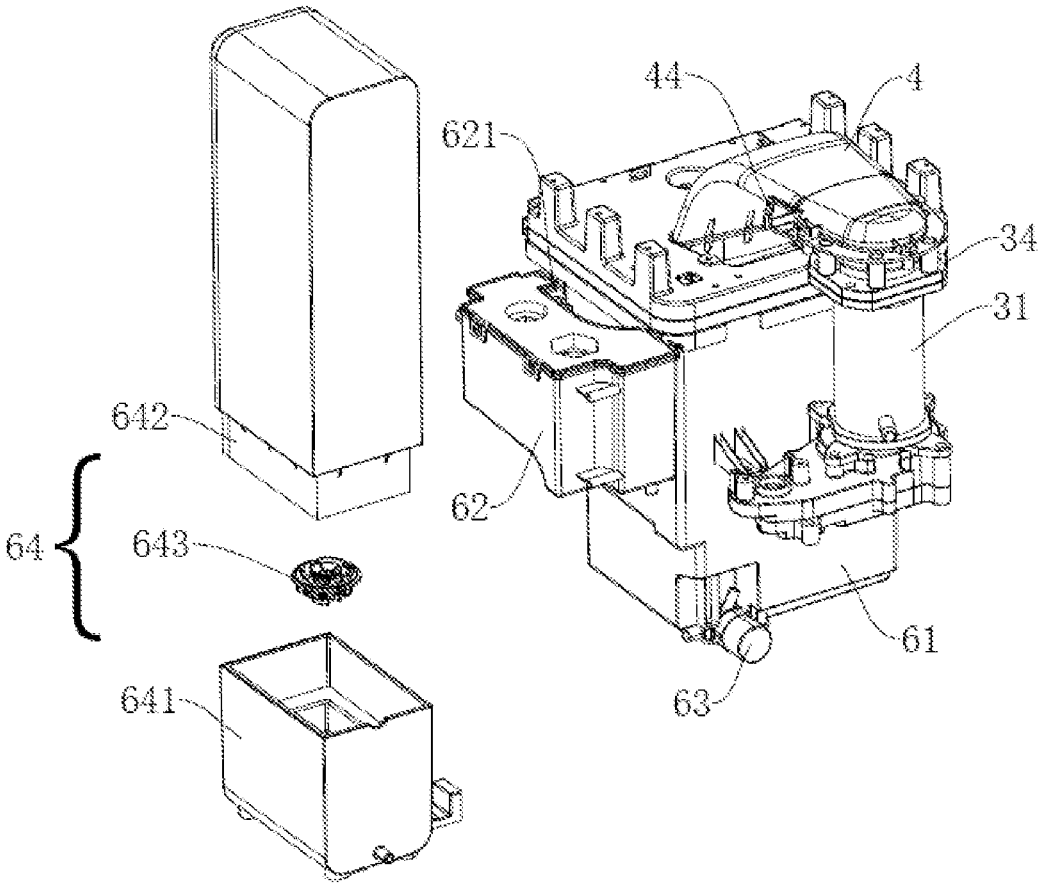
FIG. 7 is a schematic structural diagram of the water supply assembly of the Embodiment 1.

Referring to FIG. 2 and FIG. 7, the water supply assembly 6 includes a water supply liner 61 fixedly installed at the bottom of the ice storage bin 5, a water storage tank 62 connected to the water supply liner 61 and a water pump 63. The water supply liner 61 is in the form of a box with an open top. The water storage tank 62 as a whole is fixed in the casing 1 on the top. The water storage tank 62 is in communication with the ice-making drum 31. The water pump 63 is installed on the water supply liner 61, to transport the water in the water supply liner 61 from the bottom to the water storage tank 62 on the top.

The water storage tank 62 is integrally formed with a communicating pipe 621 on the top at the side facing the ice guide channel 4. The ice guide channel 4 is configured with an overflow hole 44 to be hermetically inserted into by the communicating pipe 621. The water in the water storage tank 62 can overflow into the ice guide channel 4 through the overflow hole 44, thereby improving the cleaning efficiency of the ice machine.

Figure 8:
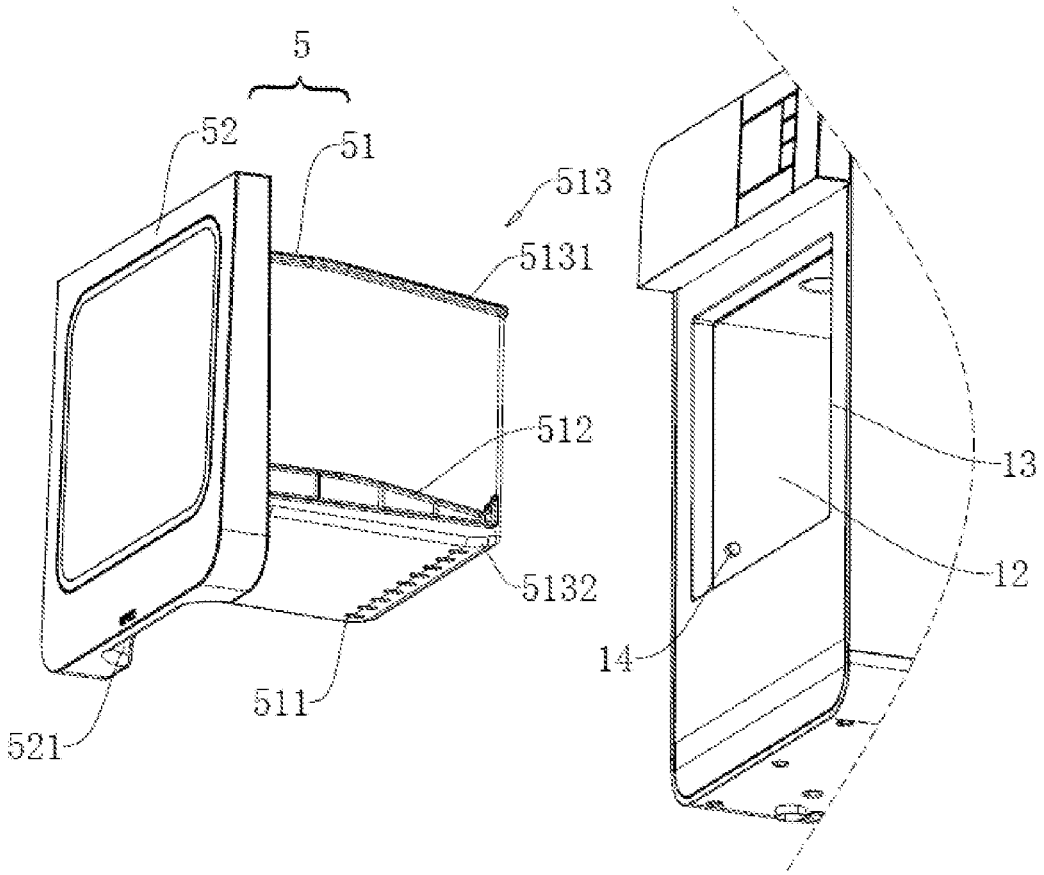
FIG. 8 is an exploded schematic diagram of the ice storage bin and the casing of the Embodiment 1.

An external water tank assembly 64 is further detachably installed on the outside of the casing 1. The external water tank assembly 64 includes an external connected seat 641 fixedly plugged in the bottom of the casing 1, an external water tank 642 plugged in the external connecting seat 641, and a communication valve 643 for controlling water discharge from the external water tank 642. The external water tank 642 is hermetically inserted in the external connected seat 641 inversely. The internal pressure is less than the external atmospheric pressure. When the water in the water supply liner 61 is consumed, the water level descends. Air enters the external water tank 642, so that the water in the external water tank 642 flows into the water supply liner 61 for replenishment. Referring to FIG. 8, the ice storage bin 5 of the disclosure is slidably installed in the casing 1 horizontally. An accommodation space 12 for installation of the ice storage bin 5 is defined in the casing 1. The side wall of the casing 1 is configured with an opening 13 in communication with the accommodation space 12, the opening is configured to be inserted into by the ice storage bin 5.

The ice storage bin 5 includes a bin body 51 and an abutment plate 52. The bin body 51 can be integrally formed with the abutment plate 52 or the both can be fixed with each other through clamping, welding or other manner. The top of the bin body 51 is in an open state. Backflow holes 511 in corresponding communication with the water supply liner 61 are defined at the bottom of the bin body 51 on the side away from the abutment plate 52. The abutment plate 52 is in the shape of a rectangular plate as a whole, and is dimensioned larger than the inner diameter of the opening 13, which can provide a positioning effect when the bin body 51 is slidingly installed. A groove 521 to be pulled by users is defined at the bottom of the abutment plate 52.

The bin body 51 is provided with limiters 512 on both side walls in the sliding direction. The limiters 512 are integrally injection molded with the bin body 51. The limiters 512 are located on the bottom walls on both sides of the bin body 51 and extend along the sliding direction of the bin body 51.

Figure 9:
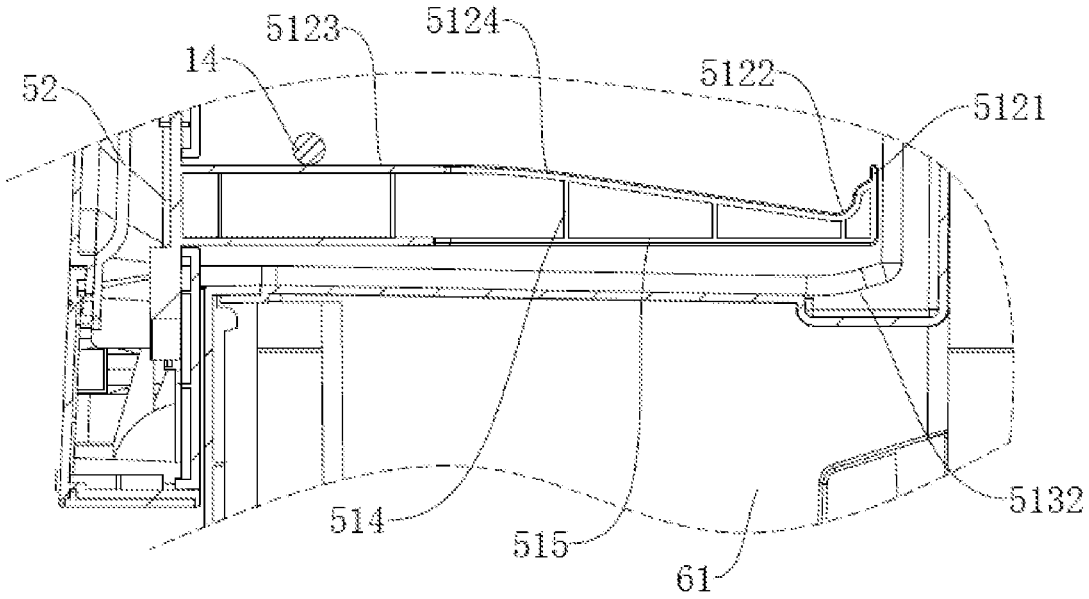
FIG. 9 is a schematic cross-sectional view of the Embodiment 1, by which the ice storage bin is inserted in the accommodation space.

Referring to FIG. 8 and FIG. 9, both side walls of the accommodation space 12 are provided with limit columns 14 to be matched with the limiters 512 for positioning. The limit column 14 is located on the side close to the opening 13. The end of the limiter 512 away from the abutment plate 52 is provided with an anti-dropping part 5121. The distance from the anti-dropping part 5121 to the bottom of the bin body 51 is greater than the distance from the limit column 14 to the bottom wall of the opening 13. Therefore, when the bin body 51 is pulled out, the probability of the bin body 51 falling off from the accommodation space 12 can be reduced through the abutment between the anti-dropping part 5121 and the limit column 14.

In order to facilitate the sliding insertion of the ice storage bin 5, the bin body 51 is provided with guide bevels 513 on both upper and lower sides at the end away from the abutment plate 52. The guide bevel 513 includes an upper guide surface 5131 at the top of the bin body 51 and a lower guide surface 5132 at the bottom of the bin body 51. In particular, the upper guide surface 5131 is inclined downward in the direction away from the abutment plate 52, and the lower guide surface 5132 is inclined upward in the direction away from the abutment plate 52.

When installing the bin body 51, the bin body 51 is at first inserted into the opening 13 in a downward-inclined posture. The anti-dropping part 5121 and the limit column 14 are staggered, so that the anti-dropping part 5121 can be inserted in on the side of the limit column 14 away from the opening 13. After the staggered insertion of the anti-dropping parts 5121 is completed, the ice storage bin 5 is pushed horizontally into the accommodation space 12 to complete the installation of the ice storage bin 5.

The limiter 512 is also configured with an arc-shaped groove 5122 for the limit column 14 at one end close to the anti-dropping part 5121. The entire arc-shaped groove 5122 is recessed toward the bottom of the bin body 51. After users pull out the ice storage bin 5, through the abutment between the anti-dropping part 5121 and the limit column 14, the ice storage bin 5 can be limited from falling off. At this time, the abutment plate 52 is rotated downward or the grip of the ice storage bin 5 is released, so that the limit column 14 abuts against the arc-shaped groove 5122, namely, the ice storage bin 5 is in an inclined downward state tending to be away from the opening 13. In the inclined state, it is easier for the users to take out the ice cubes in the bin body 51.

The limiter 512 is provided with an abutment surface 5123 configured for abutting against the limit column 14 on the side away from the anti-dropping part 5121. The abutment surface 5123 extends along the sliding direction of the bin body 51. When the ice storage bin 5 is installed, the friction force due to the abutment between the abutment surface 5123 and the limit column 14 improves the stability of the bin body 51 in the accommodation space 12. In particular, the limiter 512 is also provided with a guide transition surface between the abutment surface 5123 and the arc-shaped groove 5122, so that the bin body 51 slides back and forth in the accommodation space 12 more smoothly, thereby saving labor for users.

The bin body 51 is provided with a plurality of reinforcing strips 514 spaced apart at the bottom of the limiter 512. The reinforcing strips 514 are in the shape of vertical rods. The plurality of reinforcing strips 514 are all integrally formed with the limiter 512. The other end of the reinforcing strips 514 is also provided with a connection strip 515. The connection strip 515 is arranged along the sliding direction.

The implementation principle of the ice storage bin 5 is as follows: when installing the ice storage bin 5, the ice storage bin 5 is inserted into the accommodation space 12 in a downward inclined posture. After the anti-dropping part 5121 reaches the side of the limit column 14 away from the opening 13, the ice storage bin 5 continues to slide into the accommodation space 12 in a horizontal posture. After the abutment plate 52 abuts against the outer wall of the ice-making body, the installation of the ice storage bin 5 is completed. At this time, the limit column 14 and the abutment surface 5123 are in the abutting state. The disassembly process of the ice storage bin 5 is opposite to the installation process, that is, after the anti-dropping part 5121 abuts against the limit column 14, the abutment plate 52 is lifted, so that the limit column 14 and the anti-dropping part 5121 are staggered. Then the ice storage bin 5 is completely taken out of the accommodation space 12.

When users need to take ice cubes, the ice storage bin 5 is pulled out through the groove 521. When the anti-dropping part 5121 abuts against the limit column 14, such that the ice storage bin cannot be pulled, the abutment plate 52 is rotated downward, so that the entire ice storage bin 5 is inclined downward in a direction away from the ice-making body. The ice cubes in the ice storage bin 5 slide to the side close to the abutment plate 52 due to the gravity.

Embodiment 2

Compared with Embodiment 1, this embodiment has the same structure as the ice machine of Embodiment 1 except for an additional push mechanism 8.

Figure 10:
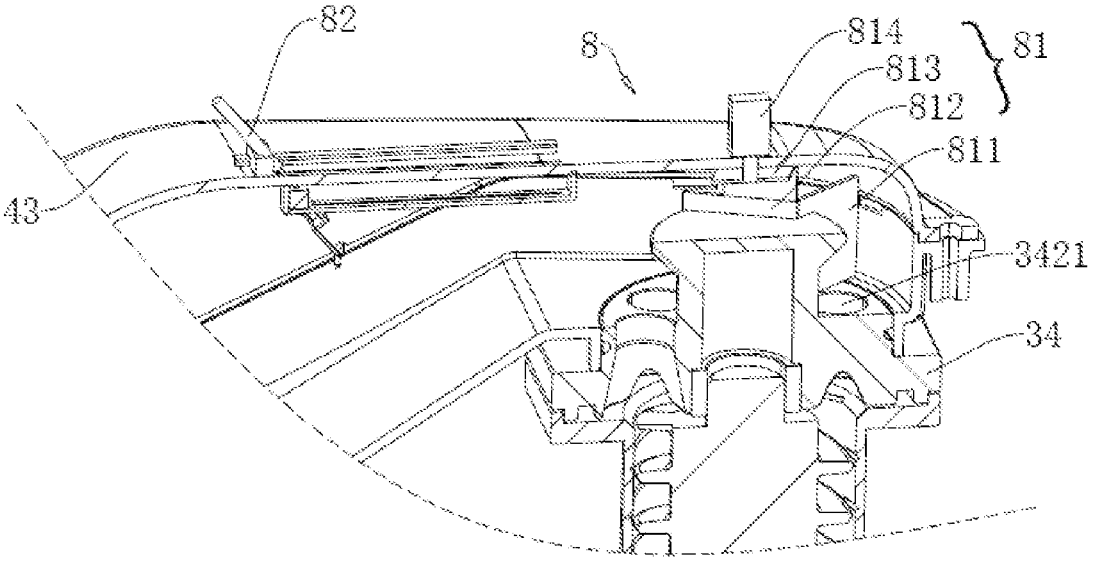
FIG. 10 is an overall schematic cross-sectional view of a push mechanism of Embodiment 2.

Referring to FIG. 10, the push mechanism 8 is disposed on the top of the cover plate 43 and is located entirely above the extruder 34. The push mechanism 8 includes a guide plate assembly 81 rotatably arranged above the extruder 34 and a push assembly 82 on one side of the guide plate in a lifting manner.

The guide plate assembly 81 includes two first side plates 811 in the guide compartment 412, second side plates 812 configured for connecting the first side plates 811, a rotatable plate 813 above the extrusion body 342, and a driver 814 for rotating the plate. The first side plates 811 are spaced apart from the output through hole 3421 and abut against the side wall of the output compartment 411, so that an accommodation compartment for accommodating ice cubes is formed between the two first side plates 811. The second side plates 812 are integrally formed with the first side plates 811. The two second side plates 812 are located on the top surface of the extrusion body 342, which can reduce the probability of ice cubes falling on both sides of the extrusion body 342 when climbing.

The rotatable plate 813 and the second side plates 812 are fixedly connected by welding or screwing and so on. The driver 814 is fixedly installed on the outer top surface of the cover plate 43. In this embodiment, the driver 814 is a cylinder, specifically a cylinder for rotation of 90 degree, the output shaft thereof passes vertically downward through the cover plate 43 and the rotatable plate 813 and is fixed. When there are too many ice cubes in the accommodation compartment, or there are ice cubes remaining in the accommodation compartment that have not climbed over the extrusion body 342 after the ice machine stops making ice. The first side plates 811 and the second side plates 812 are rotated by the driver 814, so that the accommodation compartment is in direct communication with the guide compartment 412. At the same time, when the first side plates 811 are rotated, the ice cubes in the output compartment 411 except the accommodation compartment can return to the guide compartment 412.

Figure 11:
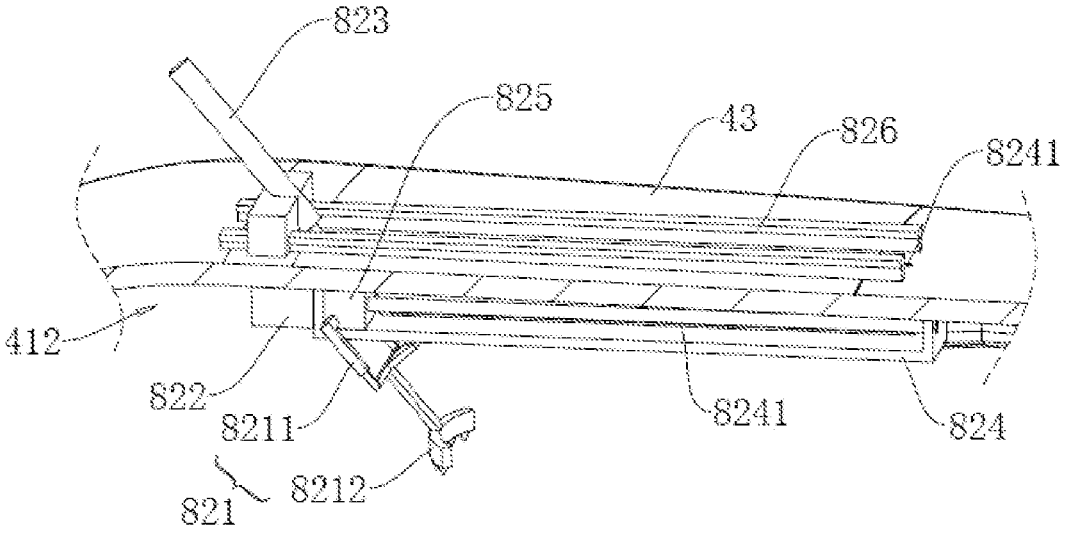
FIG. 11 is a schematic structural diagram of the push assembly of the Embodiment 2.

Referring to FIG. 10 and FIG. 11, the push assembly 82 is disposed on the side of the guide plate assembly 81 away from the extrusion body 342. The push assembly 82 includes a push arm 821 for pushing ice cubes, a shifter 822 for moving the push arm 821, and a lifter 823 for lifting the shifter 822.

The lifter 823 is fixedly installed on the cover plate 43. Its output shaft is inclined toward the direction of the extruder 34. The guide compartment 412 is provided with a base 824 for the shifter 822 and a sliding block 825 that is slidably mounted on the base. In particular, the top of the cover plate 43 is further provided with a horizontal slide rail 826 for the lifter 823 to slide horizontally.

The push arm 821 includes a telescopic rod 8211 connected with the sliding block 825 and a push plate 8212 to be inserted into the accommodation compartment to push the ice cubes. The telescopic rod 8211 includes a fixed rod fixed on both sides of the sliding block 825 and an extension rod configured to be sleeved by the fixed rod. The fixed rod and the extension rod are connected by a compression spring. The other end of the extension rod is fixedly connected to the push plate 8212.

Both the base 824 and the cover plate are configured with a strip-shaped hole 8241 for the output shaft of the lifter 823 to pass through. In particular, the cover plate is connected with sealing connection sleeves (not shown in Figure) at both ends of the strip-shaped hole 8241. The structure of the sealing connection sleeve is identical with that of the organ cover, and can expand and contract synchronously with the sliding of the lifter 823 to ensure the tightness of the ice guide channel 4.

The method for using the push assembly 82 is as follows: when making ice normally the sliding block 825 is located on the side away from the output compartment 411, and the lifter 823 is not activated. After the rotation of the guide plate assembly 81 is completed, the motor for shifting is activated to move the push arm 821 toward the accommodation compartment. At the same time, the lifter 823 also moves horizontally synchronously with the push arm 821. When the push arm 821 is located in the accommodation compartment, the lifter 823 is activated, so that the push plate 8212 is obliquely inserted into the accommodation compartment, and then the push arm 821 is moved in a direction away from the extruder 34 by the shifter, so that the push plate 8212 pushes the ice cubes to drop to the guide compartment 412.

The above are all preferred embodiments of the application, and do not limit the protection scope of the application. Therefore, any equivalent changes made based on the structure, shape, and principle of the application shall be covered by the protection scope of the application.

LIST OF REFERENCE SIGNS

1 casing
11 positioning plate
12 accommodation space
13 opening
14 limit column
2 refrigeration assembly
21 compressor
22 condenser
23 evaporator
3 ice conveying assembly
31. ice-making drum
32 ice conveying screw
33 motor
34 extruder
341 connection plate
3411 mounting hole
3412 isolation ring
342 extrusion body
3421 output through hole
3422 conical abutment surface
35 seal assembly
351 static ring
352 dynamic ring
353 elastic member
4 ice guide channel
41 delivery chamber
411 output compartment
4111 gap
4112 guide cambered surface
412 guide compartment
4121 delivery slope
42 delivery plate
421 first positioning lug
422 positioning column
423 positioning sleeve
424 sealing ring
425 positioning flange
43 cover plate
431 second positioning lug
44 overflow hole
5 ice storage bin
51 bin body
511 backflow hole
512 limiter
5121 anti-dropping part
5122 arc-shaped groove
5123 abutment surface
5124 guide transition surface
513 guide bevel
5131 upper guide surface
5132 lower guide surface
514 reinforcing strip
515 connection strip;
52. abutment plate
521 groove
6 water supply assembly
61 water supply liner
62 water storage tank
621 communicating pipe
63 water pump
64 external water tank
641 external connected seat

642 water tank
643 communication valve
7 infrared sensor
8 push mechanism
81 guide plate assembly
811 first side plate
812 second side plate
813 rotatable plate
814 driver
82 push assembly
821 push arm
8211 telescopic rod
8212 push plate
822 shifter
823 lifter
824 base
8241 strip-shaped hole
825 sliding block
826 horizontal slide rail

What is claimed is:

1. An ice machine, comprising a casing, wherein a refrigeration assembly, an ice conveying assembly, an ice storage bin and an ice guide channel are provided in the casing, wherein the ice conveying assembly comprises an ice-making drum in connection with the refrigeration assembly, an ice conveying screw rotatably provided in the ice-making drum, a motor configured to drive the ice conveying screw to rotate, and an extruder on the ice-making drum, wherein the ice guide channel is configured with an output compartment configured for outputting ice cubes, the output compartment is arranged corresponding to the extruder, the output compartment is configured with a gap on a side of the extruder away from the ice storage bin, and the gap is configured for the ice cubes to climb over a top of the extruder, wherein a seal assembly configured for hermetically connecting with the motor is provided in the ice-making drum, and the seal assembly comprises a static ring fixed on a bottom of the ice-making drum, a dynamic ring sleeved on the ice conveying screw, and an elastic member configured for connecting the dynamic ring and the static ring.

2. The ice machine according to claim 1, wherein the ice guide channel further comprises a guide compartment configured for transporting the ice cubes, the guide compartment is in communication with the ice storage bin and the output compartment, a top wall of the output compartment is provided with a guide cambered surface configured to guide the ice cubes to the gap, and the gap extends toward the guide compartment to a position above the ice storage bin.

3. The ice machine according to claim 2, wherein the ice guide channel further comprises a delivery plate fixedly mounted on the extruder and a cover plate configured for covering the delivery plate, the delivery plate is provided with a first positioning assembly configured for positioned installation, and the cover plate is provided with a second positioning assembly configured for positioned installation.

4. The ice machine according to claim 3, wherein the first positioning assembly comprises a first positioning lug on an outer wall of the delivery plate, a positioning column configured to abut against the extruder and a positioning sleeve configured to be sleeved on the extruder, the casing is provided with a positioning plate configured to abut against the first positioning lug for positioning, and the positioning plate is configured with a positioning socket into which one end of the delivery plate is inserted.

5. The ice machine according to claim 4, wherein the second positioning assembly comprises a plurality of second positioning lugs on an outer wall of the cover plate, a first part of the plurality of second positioning lugs are fixedly connected to the positioning plate, a second part of the plurality of second positioning lugs are fixedly connected to the delivery plate, and the delivery plate is provided with a positioning flange configured to abut against the second part of the plurality of second positioning lugs.

6. The ice machine according to claim 1, wherein a water supply assembly configured to provide a water source for the refrigeration assembly is provided in the casing, the water supply assembly comprises a water supply liner at a bottom of the ice storage bin, a water storage tank connected to the water supply liner, and a water pump, the water storage tank is in communication with the ice-making drum, and the water pump delivers water in the water supply liner to the water storage tank.

7. The ice machine according to claim 6, wherein a plurality of backflow holes corresponding to the water supply liner are provided spaced apart at the bottom of the ice storage bin, and an overflow hole in communication with a top of the water storage tank is defined on a side wall of the ice guide channel.

8. The ice machine according to claim 6, wherein an external water tank assembly is provided outside the casing, the external water tank assembly comprises an external connected seat connected to the casing, an external water tank plugged in the external connected seat and a communication valve configured to control a water discharge of the external water tank, and the external water tank assembly is in communication with the water supply liner.

9. The ice machine according to claim 6, wherein the casing is configured with an opening, through which the ice storage bin is slidably mounted, a limiter is provided on each side wall of the ice storage bin in a sliding direction, a limit column corresponding to the limiter is provided on a respective one of two side walls of the casing, and the limiter is provided with an anti-dropping part configured to be matched with the limit column for limiting position.

10. The ice machine according to claim 9, wherein a guide bevel is provided on a side of the ice storage bin facing the water supply liner, the guide bevel comprises an upper guide surface and a lower guide surface, the upper guide surface is inclined downward in a direction away from the opening, and the lower guide surface is inclined upward in the direction away from the opening.

11. The ice machine according to claim 10, wherein a first end of the limiter is configured with an arc-shaped groove configured for accommodating the limit column, a second end of the limiter away from the arc-shaped groove is provided with an abutment surface slidably abutting against the limit column, and when the limit column is located in the arc-shaped groove, the ice storage bin is inclined downward in a direction away from the casing.

12. The ice machine according to claim 10, wherein an abutment plate configured for abutting against an outer wall of the casing is provided on a second side of the ice storage bin away from the guide bevel, and a groove configured to be pulled by users is defined at a bottom of the abutment plate.

13. An ice machine, comprising a casing, wherein a refrigeration assembly, an ice conveying assembly, an ice storage bin and an ice guide channel are provided in the casing, wherein the ice conveying assembly comprises an ice-making drum in connection with the refrigeration assembly, an ice conveying screw rotatably provided in the ice-making drum, a motor configured to drive the ice conveying screw to rotate, and an extruder on the ice-making drum, wherein the ice guide channel is configured with an output compartment configured for outputting ice cubes, the output compartment is arranged corresponding to the extruder, the output compartment is configured with a gap on a side of the extruder away from the ice storage bin, and the gap is configured for the ice cubes to climb over a top of the extruder, wherein a water supply assembly configured to provide a water source for the refrigeration assembly is provided in the casing, the water supply assembly comprises a water supply liner at a bottom of the ice storage bin, a water storage tank connected to the water supply liner, and a water pump, the water storage tank is in communication with the ice-making drum, and the water pump delivers water in the water supply liner to the water storage tank, and wherein a plurality of backflow holes corresponding to the water supply liner are provided spaced apart at the bottom of the ice storage bin, and an overflow hole in communication with a top of the water storage tank is defined on a side wall of the ice guide channel.

* * * * *